United States Patent [19]

Young

[11] Patent Number: 4,840,274

[45] Date of Patent: Jun. 20, 1989

[54] PROTECTIVE DEVICE FOR COILS OF METAL

[76] Inventor: Gary Young, 802 Martha Dr., Franklin, Ohio 45005

[21] Appl. No.: 172,250

[22] Filed: Mar. 23, 1988

Related U.S. Application Data

[63] Continuation-in-part of Ser. No. 87,705, Aug. 21, 1987, abandoned.

[51] Int. Cl.[4] ..... B65D 85/66

[52] U.S. Cl. ..... 206/389; 206/400

[58] Field of Search ..... 206/389, 387, 399, 398, 206/400, 53

[56] References Cited

U.S. PATENT DOCUMENTS

| | | | |
|---|---|---|---|
| 3,453,695 | 7/1969 | Owen | 206/389 |
| 4,008,802 | 2/1977 | Freitag | 206/63.3 |
| 4,037,718 | 7/1977 | Stillen | 206/399 |
| 4,151,913 | 5/1979 | Freitag | 206/63.3 |
| 4,526,500 | 7/1985 | Patrick . | |

*Primary Examiner*—Joseph Man-Fu Moy

*Attorney, Agent, or Firm*—D. F. Marquette; J. C. McGowan

[57] ABSTRACT

A protective device for preventing damage to the outer layers of a coil of metal by band retainer clips. The protective device includes a bottom panel having a portion thereof disposed between the outer layer of a metal coil and a band retainer clip, a pair of cushions spaced apart to define a pocket therebetween for receiving the clip, and a top panel or lid for enclosing the clip in the pocket. In use, the cushions are located on opposite sides of the clip so that they prevent the clip from being pressed against the outer layer of the metal coil. This prevents damage to the outer layers of the metal coil during transport and storage. In one embodiment of the protective device, both of the cushions are mounted on the bottom panel while, in an alternative embodiment of the protective device, one cushion is mounted on the bottom panel and the other cushion is mounted on the top panel to provide maximum space between the cushions when the top panel is opened.

7 Claims, 3 Drawing Sheets

PROTECTIVE DEVICE FOR COILS OF METAL

BACKGROUND OF THE INVENTION

This is a continuation-in-part of application Ser. No. 087,705 filed Aug. 21, 1987, and incorporated herein by reference, now abandoned.

This invention relates to a protective device for preventing damage to coils of metal such as steel.

In the steel industry, it is customary to form thin sheet steel into coils for transport and storage. These coils consist of spirally wrapped layers of steel held together by narrow metal bands which are fastened and retained on the coils by metal clips. During transport and storage of a typical coil of steel, the band retainer clips frequently cause damage to the outer layers of the steel coil if it is positioned so that the clips are pressed against it by a truck bed or the floor of a warehouse. The outer layers of a steel coil may also be damaged when coils are arranged side by side or stacked in a manner such that the band retainer clips are pressed between adjacent coils. This often increases the warehouse space needed to store steel coils since they cannot be stacked or arranged too close together without being damaged.

In the past, flat pieces of paperboard or corrugated cardboard have been used to try to protect steel coils from the damage which may be caused by band retainer clips. These pieces of paperboard or corrugated cardboard are placed between the clips and the outer layer of a steel coil, but they have not proven successful in preventing damage to the steel coil on which they are carried or to adjacent steel coils.

SUMMARY OF THE INVENTION

It is an object of the present invention to provide a protective device for effectively preventing damage to coils of metal which may otherwise be caused by band retainer clips.

It is another object of the present invention to provide a protective device for use with coils of metal which is inexpensive, easy to manufacture, and easy to use.

It is a further object of the present invention to provide a protective device for use with coils of metal which permits more efficient use of warehouse space.

The present invention accomplishes these objects by providing a protective device for use with a coil of metal consisting of a plurality of spirally wrapped layers of sheet metal held together by at least one metal band which is retained by a clip. The protective device comprises a bottom panel having a portion thereof disposed between the outer layer of the metal coil and the clip, and a pair of cushions spaced apart to define a pocket therebetween for receiving the clip. One of the cushions is located on one side of the clip while the other cushion is located on the other side of the clip. The pocket is of sufficient depth so that the cushions prevent the clip from being pressed against the outer layer of the coil of metal thereby preventing damage to the outer layer of the coil of metal. The protective device also includes a top panel or lid hingably connected to the bottom panel so that the top panel may be opened and closed. When the top panel is closed, the clip is enclosed in the pocket. In one embodiment of the protective device, both of the cushions are mounted on the bottom panel while, in an alternative embodiment of the protective device, one cushion is mounted on the bottom panel and the other cushion is mounted on the top panel to provide maximum space between the cushions when the top panel is opened.

DESCRIPTION OF THE PREFERRED EMBODIMENT

Figure 1:
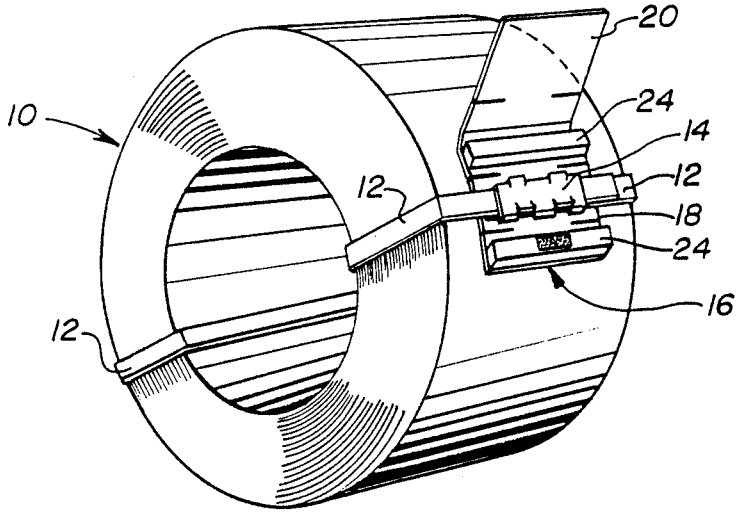
FIG. 1 is a perspective view of a coil of metal with a protective device, according to one embodiment of the present invention, in use.

Referring to FIG. 1, a coil 10 of spirally wrapped layers of thin sheet metal such as steel is held together by one or more narrow metal bands 12 extending generally radially around the coil 10. Each band 12 is fastened and retained on the coil 10 by a metal clip 14 which is installed by using a power or hand banding tool. Protective devices 16, according to one embodiment of the present invention, are carried by the coil 10 and are preferably formed of paperboard or similar material.

Figure 2:
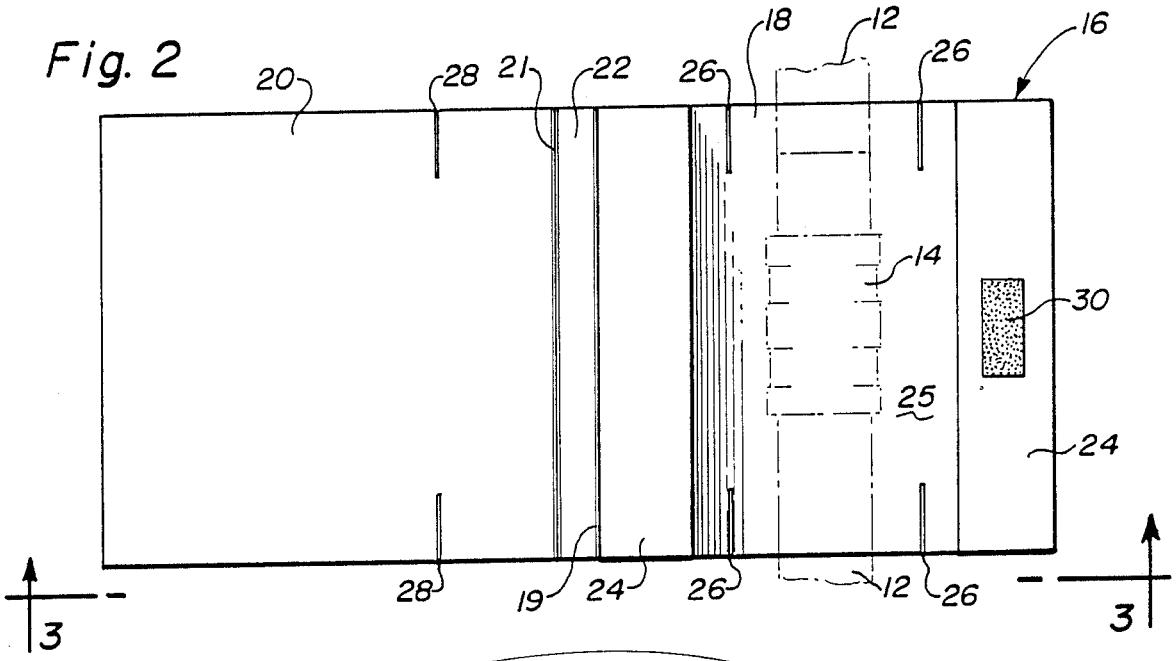
FIG. 2 is an enlarged top plan view of the protective device shown in FIG. 1.
Figure 3:
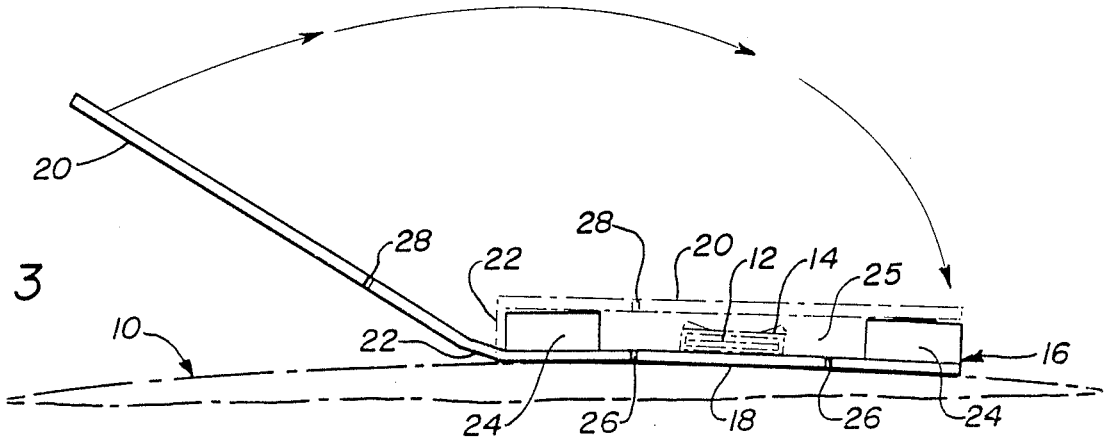
FIG. 3 is a side elevational view of the protective device taken along lines 3—3 in FIG. 2.

Each protective device 16, as also shown in FIGS. 2 and 3, includes a bottom panel 18 connected to a top panel or lid 20 by a hinge panel 22. The bottom panel 18 joins the hinge panel 22 along a first fold line 19, and the top panel 20 joins the hinge panel 22 along a second fold line 21. A pair of cushions 24 are mounted on the bottom panel 18 with one of the cushions 24 adjacent the first fold line 19. The cushions 24 are spaced apart to define a pocket 25 therebetween for receiving the clip 14. In use, one cushion 24 will be located on one side of the clip 14 while the other cushion 24 will be located on the other side of the clip 14. Slits 26 and 28 are formed in the bottom and top panels 18 and 20, respectively, to give the protective device 16 sufficient flexibility to conform to the outer curvature of the coil 10. An adhesive strip 30 is provided on one of the cushions 24 to hold the top panel 20 down when it is folded over the bottom panel 18 as shown in FIG. 3.

In the protective device 16, the panels 18, 20 and 22 are constructed of $\frac{1}{8}$ inch thick paperboard. The bottom and top panels 18, 20 are each 6 inches square while the hinge panel 22 is $\frac{1}{2}$ inch wide and 6 inches long. The cushions 24 are constructed of $\frac{1}{2}$ inch thick paperboard or rubber. Each cushion 24 is $1\frac{1}{4}$ inch wide and 6 inches long. The pocket 25 is $3\frac{1}{2}$ inches wide, 6 inches long and $\frac{1}{2}$ inch deep. The slits 26 and 28 are each 1 inch long.

When the coil 10 has been formed and is ready to be secured by the bands 12, the bottom panel 18 of a protective device 16 is disposed as seen in FIG. 1 with a portion thereof between the outer layer of the coil 10 and each band 12 before the clips 14 are installed. The top panel 20 of the protective device 16 is opened as shown in solid lines in FIG. 3. Subsequent installation of the clips 14 results in each clip 14 being received in a pocket 25 between a pair of cushions 24. The top panel 20 is then folded over the bottom panel 18 so that it is closed as shown in phantom in FIG. 3 thereby enclosing the clip 14 in the pocket 25. The top panel 20 is secured by the adhesive strip 30.

Referring to FIG. 3, it will be understood that the pocket 25 must be of sufficient depth so that the cushions 24 prevent the clips 14 from being pressed against the outer layer of the coil 10 by a truck bed or a warehouse floor while also preventing the clips 14 from being pressed between the outer layer of the coil 10 and the outer layer of another coil which is arranged side by side the coil 10 or which is stacked on top of the coil 10. This prevents damage to the outer layers of the coil 10 and to the outer layers of adjacent coils.

In a variation of the protective device 16 (not shown), the cushions 24 are mounted on the top panel 20 rather than on the bottom panel 18. When the top panel 20 is closed, the cushions 24 are disposed on opposite sides of the clip 14 thereby enclosing the clip 14 in the pocket 25 formed between the cushions 24.

Figure 4:
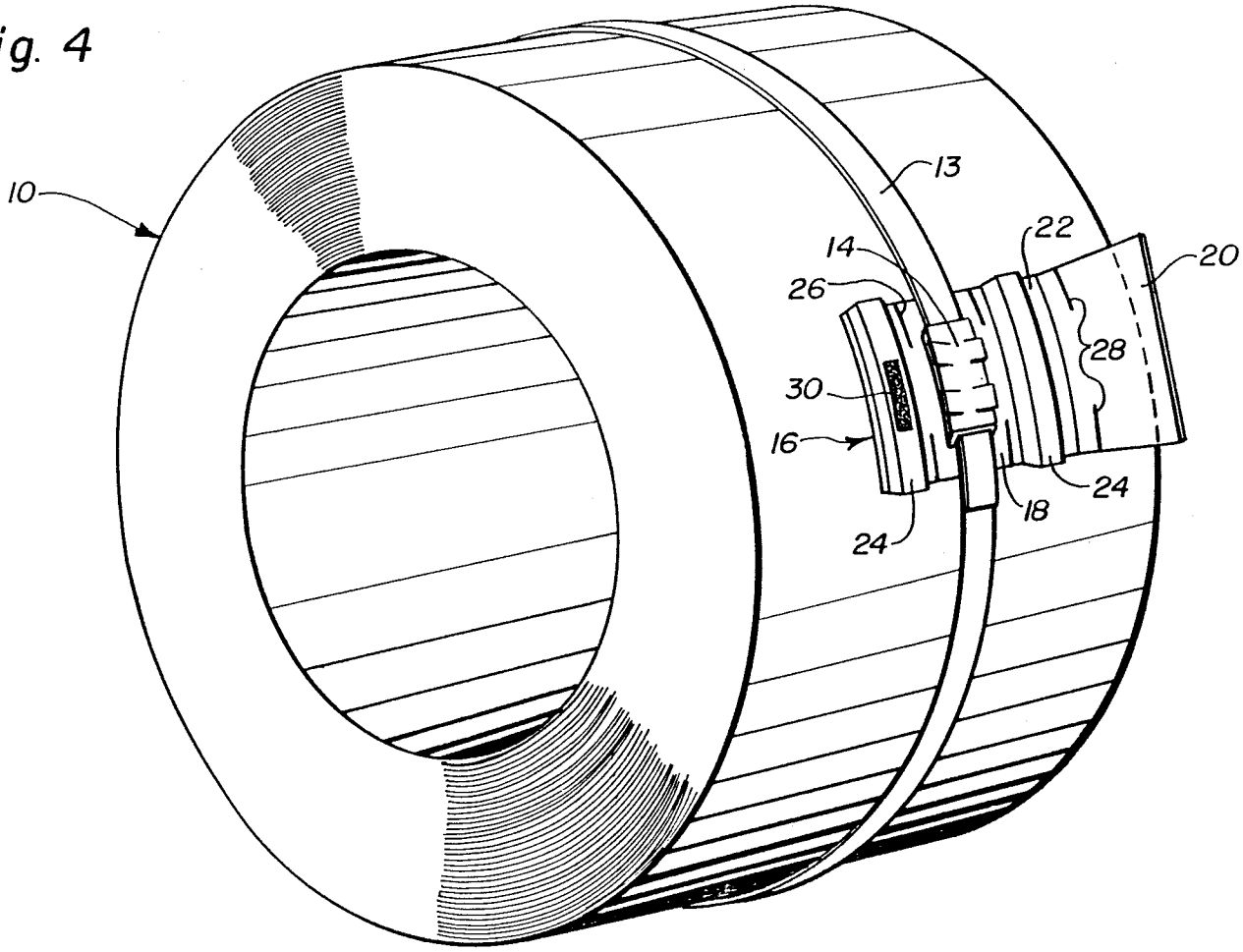
FIG. 4 is a perspective view similar to FIG. 1 illustrating an alternative use of the protective device.

In an alternative use of the protective device 16 shown in FIG. 4, a coil 10 of sheet metal is held together by a metal band 13 similar to metal bands 12 except that band 13 extends circumferentially, instead of radially, around the coil 10. The band 13 is fastened and retained on the coil 10 by a metal clip 14, and the protective device 16 is carried by the coil 10. The protective device 16 as used in FIG. 4 is oriented 90 degrees from the orientation shown in FIG. 1 so that the clip 14 is received in the pocket formed between the cushions 24.

Figure 5:
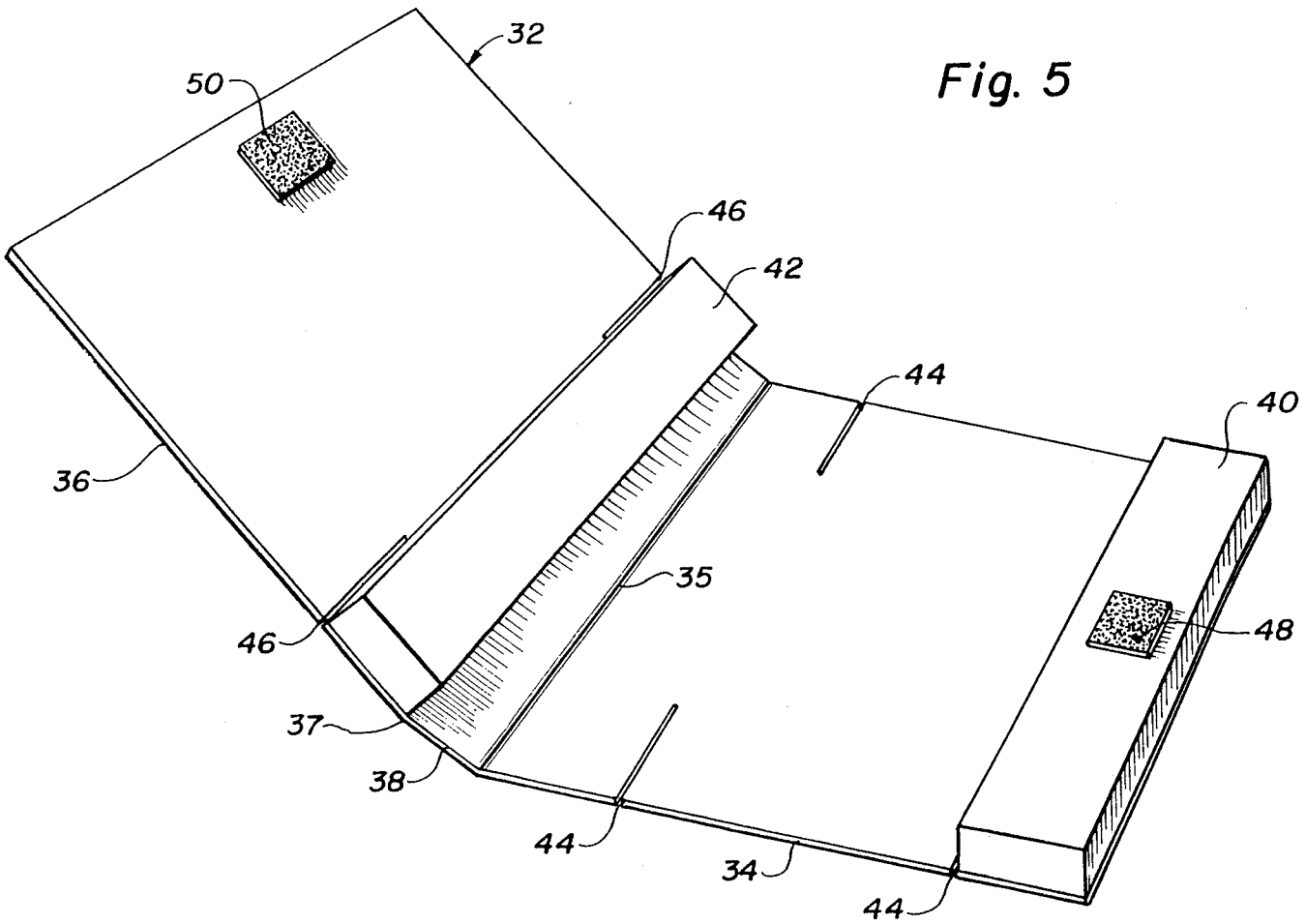
FIG. 5 is an enlarged perspective view of an alternative embodiment of the protective device.

Referring to FIG. 5, an alternative protective device 32 includes a bottom panel 34, a top panel 36 and a hinge panel 38 which are identical to the bottom panel 18, the top panel 20 and the hinge panel 22, respectively, of the protective device 16. The bottom panel 34 is joined to the hinge panel 38 along a first fold line 35 and the top panel 36 is joined to the hinge panel 38 along a second fold line 37. A cushion 40 is mounted on the bottom panel 34, and a cushion 42 is mounted on the top panel 36 adjacent the second fold line 37. The cushions 40, 42 are identical to the cushions 24 in the protective device 16. Slits 44 are provided in the bottom panel 34, and slits 46 are provided in the top panel 36. Velcro strips 48 and 50 are attached to the cushion 40 and the top panel 36, respectively, to secure the top panel 36 when it is closed. Protective device 32 may be used in the same manner as protective device 16. That is, cushions 40 and 42 define a pocket (similar to pocket 25) therebetween for receiving a coil banding clip such as clip 14 when the top panel 36 is closed. Since the cushion 42 is mounted on the top panel 36, maximum space is provided between cushions 40 and 42 when the top panel 36 is opened thereby allowing the use of modern banding machines which have inherent accuracy problems.

It will be understood that the top panel 20 and the hinge panel 22 of the protective device 16 may be eliminated if desired, but the top panel 36 and the hinge panel 38 of the protective device 32 are essential.

The protective devices 16 and 32 prevent damage to coils of metal which may be caused by band retainer clips. The protective devices 16 and 32 are inexpensive, easy to manufacture and easy to use, while also permitting more efficient use of warehouse space since metal coils may be stacked on top of each other without being damaged by band retainer clips when the protective devices 16 and 32 are utilized.

What is claimed is:

1. A protective device for a coil of metal including a plurality of sprially wrapped layers of sheet metal held together by at least one band which is retained by a clip, said protective device comprising:

a bottom panel having a portion thereof disposed between the outer layer of said coil of metal and said clip;

a top panel hingable connected to said bottom panel so that said top panel may be opened and closed;

a pair of cushions spaced apart to define a pocket therebetween for receiving said clip, one of said cushions being mounted on said bottom panel while the other one of said cushions is mounted on said top panel in order to provide maximum space between said cushions when said top panel is opened; and said top panel enclosing said clip in said pocket when said top panel is closed.

2. The protective device of claim 1, wherein one of said cushions is located on one side of said clip while the other cushion is located on the other side of said clip when said top panel is closed.

3. The protective device of claim 2, wherein said pocket is of sufficient depth so that said cushions prevent said clip from being pressed against the outer layer of said coil of metal thereby preventing damage to the outer layer of said coil of metal.

4. The protective device of claim 3, wherein said top panel is connected to said bottom panel by a hinge panel, said bottom panel joining said hinge panel along a first fold line, and said top panel joining said hinge panel along a second fold line.

5. The protective device of claim 4, wherein the other one of said cushions is mounted adjacent said second fold line.

6. The protective device of claim 1, further comprising means for holding said top panel down when it is folded over said bottom panel.

7. The protective device of claim 1, wherein said bottom and top panels have slits formed therein to give the protective device sufficient flexibility to conform to the outer curvature of said coil of metal.

* * * * *